US010909895B2

(12) United States Patent
Hyodo

(10) Patent No.: US 10,909,895 B2
(45) Date of Patent: Feb. 2, 2021

(54) CORRECTION SYSTEM, DISPLAY PANEL, DISPLAY DEVICE, CORRECTION METHOD, AND STORAGE MEDIUM

(71) Applicant: SAKAI DISPLAY PRODUCTS CORPORATION, Sakai (JP)

(72) Inventor: Masaaki Hyodo, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/468,807

(22) PCT Filed: Dec. 20, 2016

(86) PCT No.: PCT/JP2016/087990
§ 371 (c)(1),
(2) Date: Jul. 22, 2019

(87) PCT Pub. No.: WO2018/116380
PCT Pub. Date: Jun. 28, 2018

(65) Prior Publication Data
US 2020/0074905 A1 Mar. 5, 2020

(51) Int. Cl.
*G09G 3/36* (2006.01)
*G09G 3/20* (2006.01)

(52) U.S. Cl.
CPC ..... *G09G 3/20* (2013.01); *G09G 2320/029* (2013.01); *G09G 2320/0233* (2013.01); *G09G 2320/0693* (2013.01)

(58) Field of Classification Search
CPC ... G09G 3/36; G09G 5/00; G09G 3/30; G06F 3/041; G06F 3/045; G06F 3/038
See application file for complete search history.

(56) References Cited

U.S. PATENT DOCUMENTS 5,793,344 A * 8/1998 Koyama ..... G09G 3/006 345/87
9,183,811 B2 11/2015 Sasaki
2008/0062164 A1* 3/2008 Bassi ..... H04N 9/3194 345/214
2011/0157115 A1* 6/2011 Shao ..... G09G 3/006 345/207
2013/0342558 A1* 12/2013 Sasaki ..... G09G 5/02 345/589

FOREIGN PATENT DOCUMENTS

WO 2012/133890 A1 10/2012

* cited by examiner

*Primary Examiner* — Pegeman Karimi
(74) *Attorney, Agent, or Firm* — ScienBiziP, P.C.

(57) ABSTRACT

The present invention provides a correction system (1) in which a control circuit (40) of a display panel (2) generates unevenness correction data to be used for correcting display unevenness. The correction system includes a signal source (11), an imaging device (12), and a control device (13). The signal source outputs a signal for displaying a prescribed reference image on the display panel. The imaging device captures the reference image displayed on the display panel on the basis of the signal from the signal source and generates a captured image. The control device generates unevenness correction data for the display panel on the basis of the captured image. The control device generates unevenness correction data (51, 52) having a plurality of mutually different formats (F1, F2) for the display panel (S15A, S15B), and records the same in a storage unit (21) of the display panel (S16).

19 Claims, 8 Drawing Sheets

CORRECTION SYSTEM, DISPLAY PANEL, DISPLAY DEVICE, CORRECTION METHOD, AND STORAGE MEDIUM

TECHNICAL FIELD

The present invention relates to a correction system for correcting display unevenness in a display panel, a display panel, a display apparatus, a correction method, and a program.

BACKGROUND ART

A conventional technique is known for correcting display unevenness such as unevenness in luminance or color of a display image in a display apparatus including a display panel such as a liquid crystal panel (refer to Patent Literature 1, for example).

Patent Literature 1 discloses a correction system for correcting display unevenness of a display panel. The correction system according to Patent Literature 1 includes a signal source which supplies image data to the display panel, a camera which captures an image of a display area of the display panel, and a computer which generates correction data for the display panel based on the captured image. The correction system according to Patent Literature 1 uses a volatile storage device, such as dynamic random-access memory (DRAM) included in display apparatuses, as a storage device to store the correction data in order to shorten time for writing the correction data or time for deleting the correction data for each display apparatus including the display panel.

CITATION UST

Patent Literature

[Patent Literature 1]
Patent Literature 1: WO 2012/133890

SUMMARY OF INVENTION

Technical Problem

An objective of the present invention is to provide a correction system, a display panel, a display apparatus, a correction method, and a program capable of facilitating production management of display panels.

Solution to Problem

A correction system according to an aspect of the present invention is for generating unevenness correction data to be used by a control circuit for correcting display unevenness of a display panel. The correction system includes a signal source, an image capture device, and a control device. The signal source outputs a signal to cause a prescribed reference image to be displayed on the display panel. The image capture device generates a captured image by capturing an image of the reference image displayed on the display panel based on the signal. The control device generates the unevenness correction data for the display panel based on the captured image. The control device generates the unevenness correction data in a plurality of mutually different formats for the display panel and records the unevenness correction data to storage of the display panel.

A display panel according to an aspect of the present invention is a display panel in which display of an image is controlled by a control circuit. The display panel includes a display section and storage. The display section displays the image. The storage stores characteristic information of the display panel. The storage stores therein unevenness correction data used by the control circuit for correcting display unevenness of the display panel. The unevenness correction data is stored in a plurality of mutually different formats.

A display apparatus according to an aspect of the present invention includes the display panel and a control circuit which corrects display unevenness of the display, panel based on unevenness correction data in a specific format among the unevenness correction data in the plurality of formats recorded in storage.

A correction method according to an aspect of the present invention is for generating unevenness correction data to be used by a control circuit for correcting display unevenness of a display panel.

A program according to an aspect of the present invention is for causing a control device to perform the correction method.

Advantageous Effects of Invention

Through the correction system, the display panel, the display apparatus, the correction method, and the program according to the present invention, unevenness correction data respectively following a plurality of mutually different formats is set to the display panel. Through the above, production management of display panels can be facilitated.

DESCRIPTION OF EMBODIMENTS

The following describes embodiments of the present invention with reference to the accompanying drawings. Elements of configuration that are the same in the following embodiments are labeled with the same reference signs.

First Embodiment

1. Configuration

The following describes configuration of a correction system according to a first embodiment.

1-1. System Configuration

Figure 1:
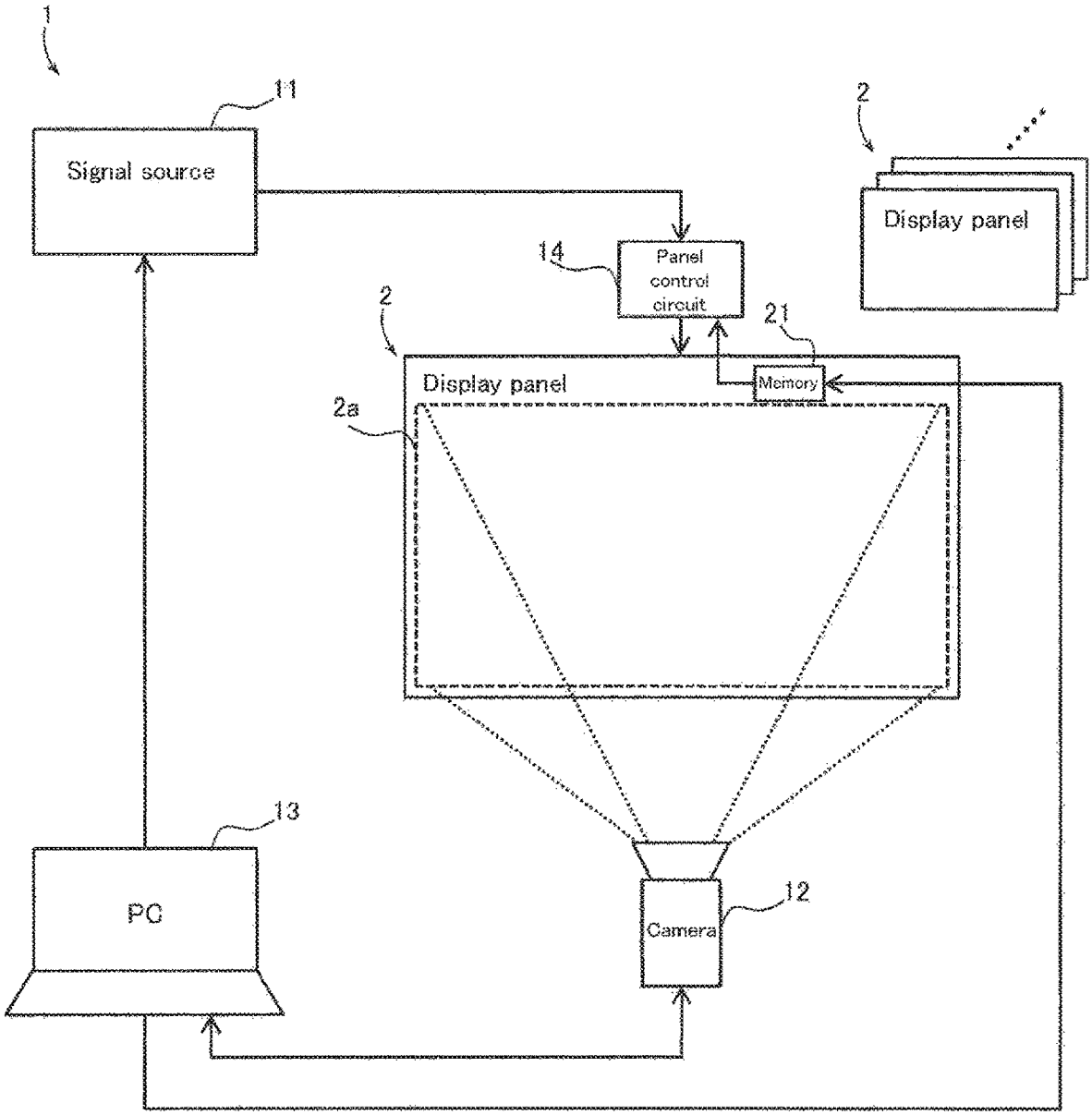
FIG. 1 is a block diagram illustrating an overall configuration of a correction system according to a first embodiment.

The following describes overall configuration of the correction system according to the first embodiment with reference to FIG. 1. FIG. 1 is a block diagram illustrating the overall configuration of a correction system 1 according to the present embodiment.

As illustrated in FIG. 1, the correction system 1 according to the present embodiment includes a signal source 11, a camera 12, a personal computer (PC) 13, and a panel control circuit 14. The correction system 1 is a system that performs setting for correcting display unevenness of an image displayed by each of a plurality of display panels 2 in for example the manufacture or shipment of the display panels 2.

Each display panel 2 is for example an open cell liquid crystal panel, in which image display is controlled externally by the panel control circuit 14 or the like. The display panel 2 includes for example a display area 2*a* in which an image is displayed through a plurality of pixels arranged in a matrix. The display panel 2 includes memory 21 such as Serial Peripheral Interface (SPI) flash memory. Characteristic information of the display panel 2, for example, is recorded in the memory 21. The memory 21 is an example of storage of the display panel 2.

The signal source 11 is a signal-generating circuit Which generates an image signal indicating an image (reference image) to be displayed on a display panel 2 undergoing processing by the correction system 1. Under the control of the PC 13 for example, the signal source 11 outputs the image signal the panel control circuit 14.

The camera 12 includes an image sensor such as a charge-coupled device (CCD) or complementary metal-oxide-semiconductor (CMOS) image sensor and an image-capturing optical system such as a zoom lens and a focus lens. Under control of the PC 13 for example, the camera 12 captures an image shown in the display area 2*a* of the display panel 2 undergoing processing. The camera 12 generates captured image data indicating the captured image and outputs the generated captured image data to the PC 13. The camera 12 is an example of an image capture device according to the present embodiment.

The PC 13 controls operation of each section of the signal source 11, the camera 12, and the like in the correction system 1. The PC 13 is connected to the memory 21 of the display panel 2 through for example a prescribed interface circuit (not illustrated), and writes various information to the memory 21. The PC 13 is an example of a control device according to the present embodiment. The configuration of the PC 13 is described later in detail.

The panel control circuit 14 is a dedicated circuit for controlling the image display of the display panel 2. The panel control circuit 14 in the correction system 1 is connected to the signal source 11 and the display panel 2 undergoing processing, and controls the image display of the display panel 2 based on the image signal from the signal source 11. As such, the panel control circuit 14 can read out and use various information from the memory 21 of the display panel 2.

The correction system 1 may include a backlight to be connected to the display, panel 2 undergoing processing in a case where a backlight of the display panel 2 is to be externally attached.

1-2. PC Configuration

Figure 2:
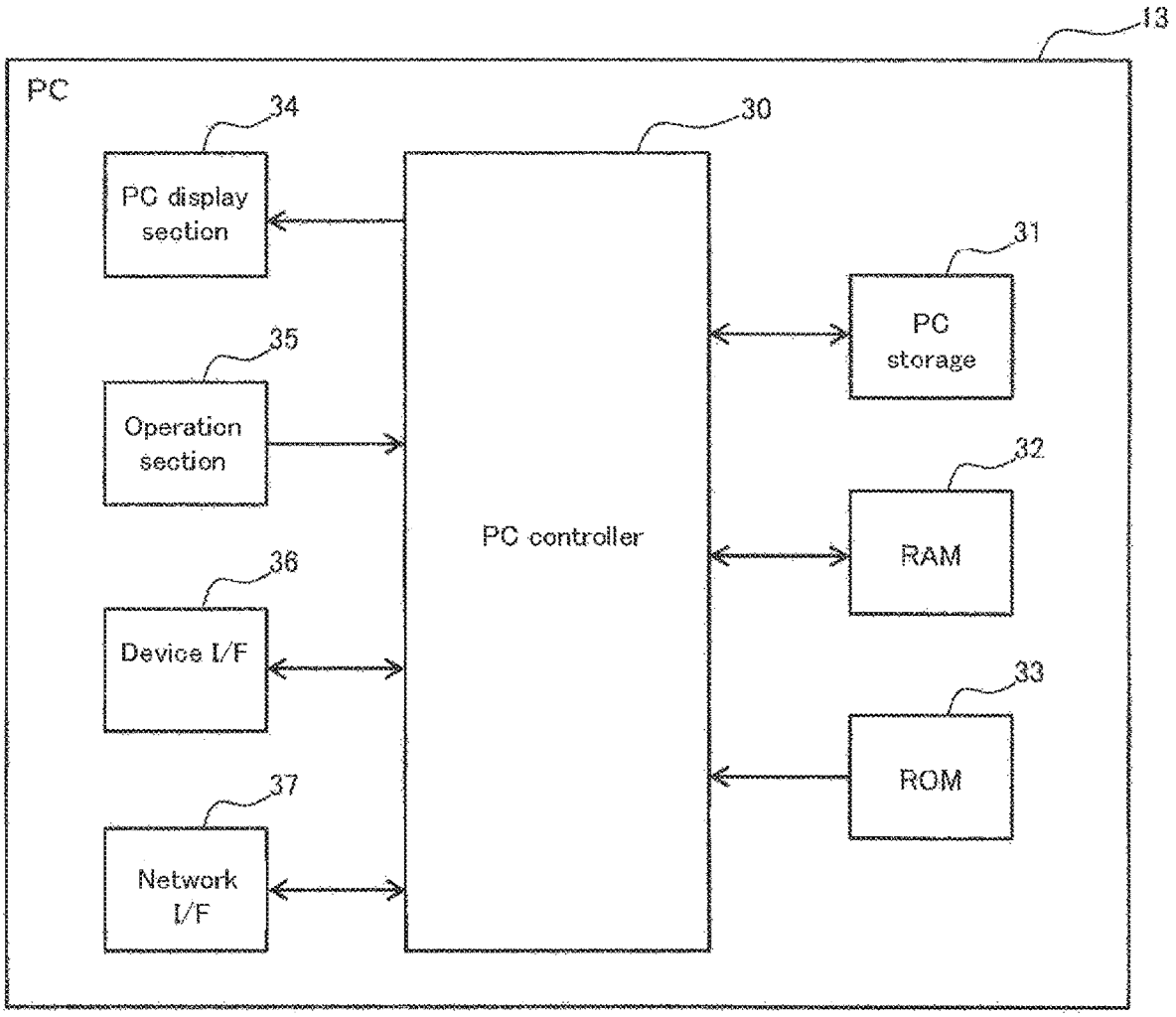
FIG. 2 is a block diagram illustrating a configuration of a PC in the correction system.

The following describes the configuration of the PC 13 according to the present embodiment in detail with reference to FIG. 2. FIG. 2 is a block diagram illustrating the configuration of the PC 13 in the correction system 1.

As illustrated in FIG. 2, the PC 13 includes a PC controller 30, PC storage 31, random-access memory (RAM) 32, read-only memory (ROM) 33, a PC display section 34, an operation section 35, a device interface (I/F) 36, and a network interface (I/F) 37.

The PC controller 30 is configured as for example a central processing unit (CPU) or a microprocessor unit (MPU) which implements prescribed functions in cooperation with software, and controls overall operation of the PC 13. The PC controller 30 reads out data or programs stored in the PC storage 31 to perform various computation processes and implement various functions. For example, the PC controller 30 performs a generation process of unevenness correction data (described later in detail) through Which information (unevenness correction data) for setting a display panel 2 is generated by executing a prescribed program to perform image analysis on a captured image indicated by captured image data (refer to FIG. 5).

Note that the PC controller 30 may be a hardware circuit such as a dedicated electronic circuit or a reconfigurable electronic circuit designed to implement a prescribed function. The PC controller 30 may also be configured as various semiconductor integrated circuits such as a CPU, an MPU, a microcomputer, a digital signal processor (DSP), a field-programmable gate array (FPGA), or an application-specific integrated circuit (ASIC).

The PC storage 31 is a storage medium which stores programs and data necessary to implement the functions of the PC 13. The PC storage 31 is configured as a hard disk drive (HDD) or a semiconductor storage device (SSD), for example. The PC storage 31 for example stores a program for causing the PC controller 30 to perform the generation process of the unevenness correction data.

The RAM 32 is configured as for example a semiconductor device including DRAM, static RAM (SRAM), or the like, and temporarily stores data. The RAM 32 may also function as a work area of the PC controller 30. The RAM 32 stores therein captured image data and correction data, for example.

The ROM 33 stores therein programs to be executed by the PC controller 30 and fixed parameters, for example.

The PC display section 34 is configured as a liquid crystal display or an organic electroluminescent (EL) display, for example. The PC display section 34 displays various information such as the captured image indicated by the captured image data, for example.

The operation section 35 is a user interface on which a user performs operation. The operation section 35 is configured as a keyboard, a touch pad, a touch panel, a button, a switch, or a combination thereof, for example.

The device interface 36 is a circuit (module) for connecting another device to the PC 13, The device interface 36 performs communication according to a prescribed communication standard. Examples of the prescribed communication standard include Universal Serial Bus (USB), HIGH-DEFINITION MULTIMEDIA INTERFACE (HDMI) (registered Japanese trademark), IEEE 1395, WiFi, and BLUETOOTH (registered Japanese trademark). The PC 13 connects to the signal source 11, the camera. 12, and the like through the device interface 36.

The network interface 37 is a circuit (module) for connecting the PC 13 to a network through a wireless or wired communication line. The network interface 37 performs communication in accordance with a prescribed communication standard. Examples of the prescribed communication standard include IEEE 802.3 and IEEE 802.11a/11b/11g/

11ac. The signal source 11 and the camera 12 may also be connected to the PC 13 through the network interface 37.

2. Operation

The following describes the operation of the correction system 1 configured as above.

2-1. Overview of Operation

The following describes an overview of the operation of the correction system 1 and a problem to be solved according to the present embodiment. The correction system 1 according to the present embodiment (FIG. 1) generates unevenness correction data for correcting display unevenness in individual display panels 2 in for example manufacture or shipment of the display panels 2 at a component producer. Each display panel 2 is shipped in a state in which the unevenness correction data is set, and is to be included in a display apparatus 4 such as that illustrated in FIG. 7 along with a separately prepared panel control circuit 40 at for example a finished goods producer. In the display apparatus 4, the panel control circuit 40 uses the unevenness correction data set to the display panel 2 to control the image display of the display panel correction of display unevenness.

Conventionally, in order to allow a panel control circuit to function for correction of display unevenness in a correction system, unevenness correction data is set for a display panel in formats differing according to the specification of the panel control circuit. That is, a conventional correction system generates unevenness correction data following a format according to the specification of the panel control circuit meant to be combined with a display panel and records the unevenness correction data to the memory of the same display panel.

Figure 3:
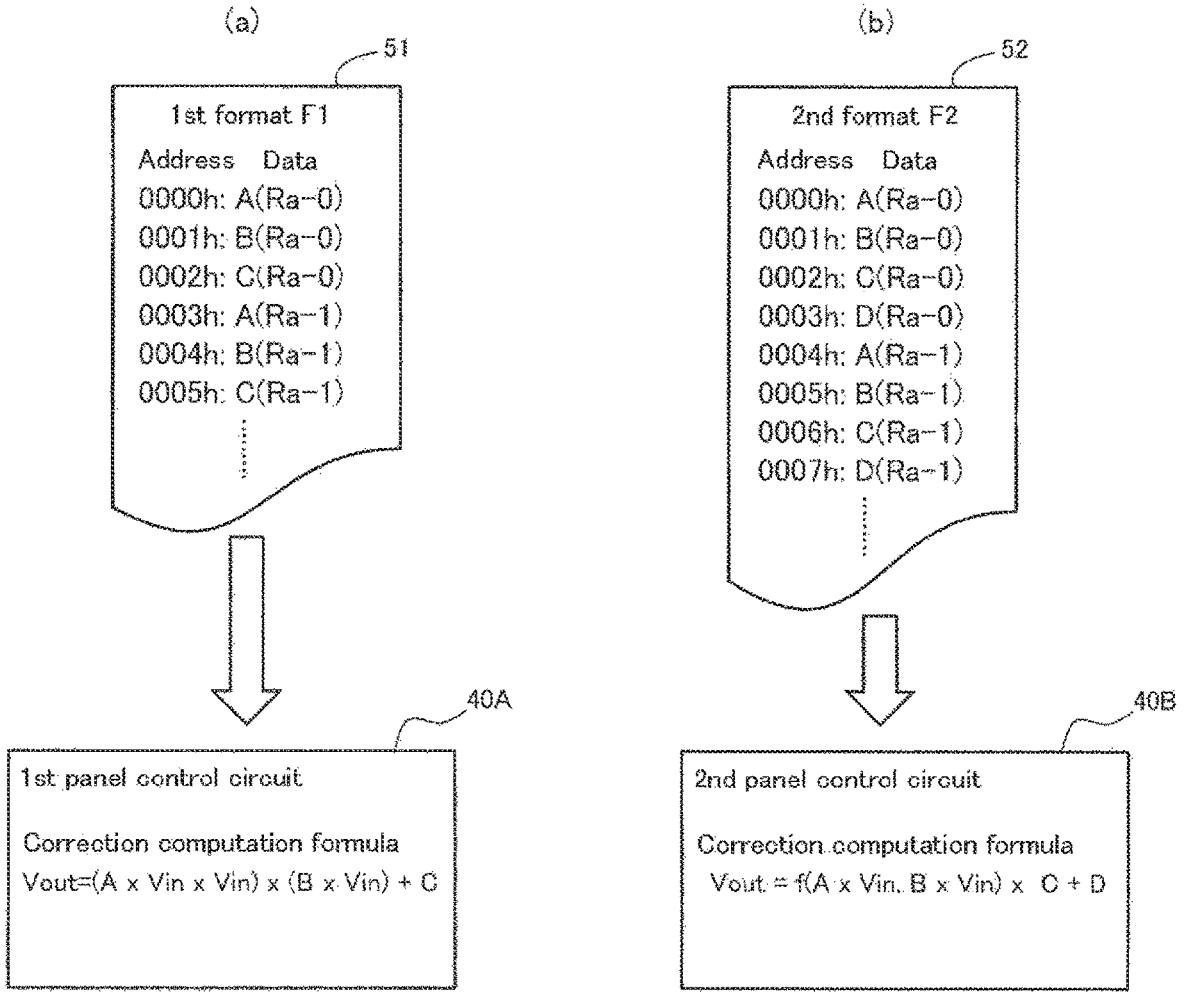
FIG. 3 is a diagram for describing various formats of unevenness correction data.

The formats of such unevenness correction data are not particularly standardized, and there are various formats serving as dedicated formats for panel control circuits with various specifications. The following describes the format of the unevenness correction data using FIG. 3, FIG. 3 is a diagram for describing a plurality of different formats for the unevenness correction data. In FIG. 3, two different formats, or first and second formats F1 and F2, are illustrated as an example. The first and second formats F1 and F2 are respective dedicated formats for first and second panel control circuits 40A and 40B mutually differing in specification.

(a) in FIG. 3 illustrates an example of unevenness correction data 51 stored in the first format F1 according to the first panel control circuit 40A. In the present example, the first panel control circuit 40A computes a formula (1) to perform correction of display unevenness.

$$Vout=(A\times Vin\times Vin)\times(B\times Vin)+C \quad (1)$$

In the above formula (1), Vin is an input value of a tone for each pixel, Vout is an output value indicating a result of correction of the tone of the same pixel, and A, B, and C are parameters. According to the specification of the first panel control circuit 40A employing the above formula (1), the first format F1 defines the values of the parameters A, B, and C of the above formula (1) for each specific division Ra (refer to FIG. 4). Each division Ra is an area dividing the display area of the display panel 2 into prescribed units of 8×8 pixels, 4×4 pixels, or the like (later described in detail).

The unevenness correction data 51 following the first format F1 includes the values of the parameters A, B, and C for each division Ra and these values are stored in the memory 21 as illustrated in (a) of FIG. 3. The first panel control circuit 40A interprets the unevenness correction data 51 in the first format F1 and calculates for each pixel the output value Vout from the formula (1) using the input value Viii and the parameters A, B, and C for a division Ra. Through the above, the first panel control circuit 40A can implement correction of display unevenness.

(b) in FIG. 3 illustrates an example of unevenness correction data 52 stored in the second format F2 according to the second panel control circuit 40B with a specification differing from the first panel control circuit 40A. In the present example, the second panel control circuit 40B employs the following formula (2) instead of the formula (1) for the first panel control circuit 40A.

$$Vout=f(A\times Vin,B\times Vin)\times C+D \quad (2)$$

In the above formula (2), parameters A, B, C, and D are separate parameters from the parameters of the formula (1), and a function f( ) is a prescribed function. The second format F2 according to the above formula (2) defines values of the parameters A, B, C, and D of the above formula (2) for each division Ra in the display panel 2. That is, the unevenness correction data 52 following the second format F2 includes the values of the parameters A, B, C, and D for each division Ra, and these values are stored in the memory 21 as illustrated in (b) of FIG. 3.

The second panel control circuit 40B interprets the unevenness correction data 52 in the second format F2, and can implement correction of display unevenness by computing for each pixel the formula (2) using the input value Vin and the parameters A, B, C, and D for the divisions Ra.

Herein, the second panel control circuit 40B is capable of interpreting the parameters A, B, C, and D of the formula (2) but cannot interpret the parameters A, B, and C of the other formula (1). That is, the second panel control circuit 40B cannot use the unevenness correction data 51 in the first format F1 to correct display unevenness. Similarly, the first panel control circuit 40A cannot use the unevenness correction data 52 in the second format F2 to correct display unevenness.

The specifications of the above panel control circuits 40A and 40B cover a broad range such as update of the computation methods in unevenness correction, size of the divisions Ra (8×8, 8×4, 4×4, etc.), and setting of drive frequency (60 Hz, 120 Hz, etc.), and various formats may exist according to this broad range.

In a conventional correction system, it is necessary to perform production management of the display panels 2 so as to individually manage the display panels 2 as dedicated products to be combined with panel control circuits of corresponding specifications for each format used to set unevenness correction data. As such, the component producer for example must bear the cost of managing the display panels 2 before shipment and the risk of holding a stock of display panels 2 for each format for each specification of panel control circuit that can be used by the finished goods producer.

Figure 4:
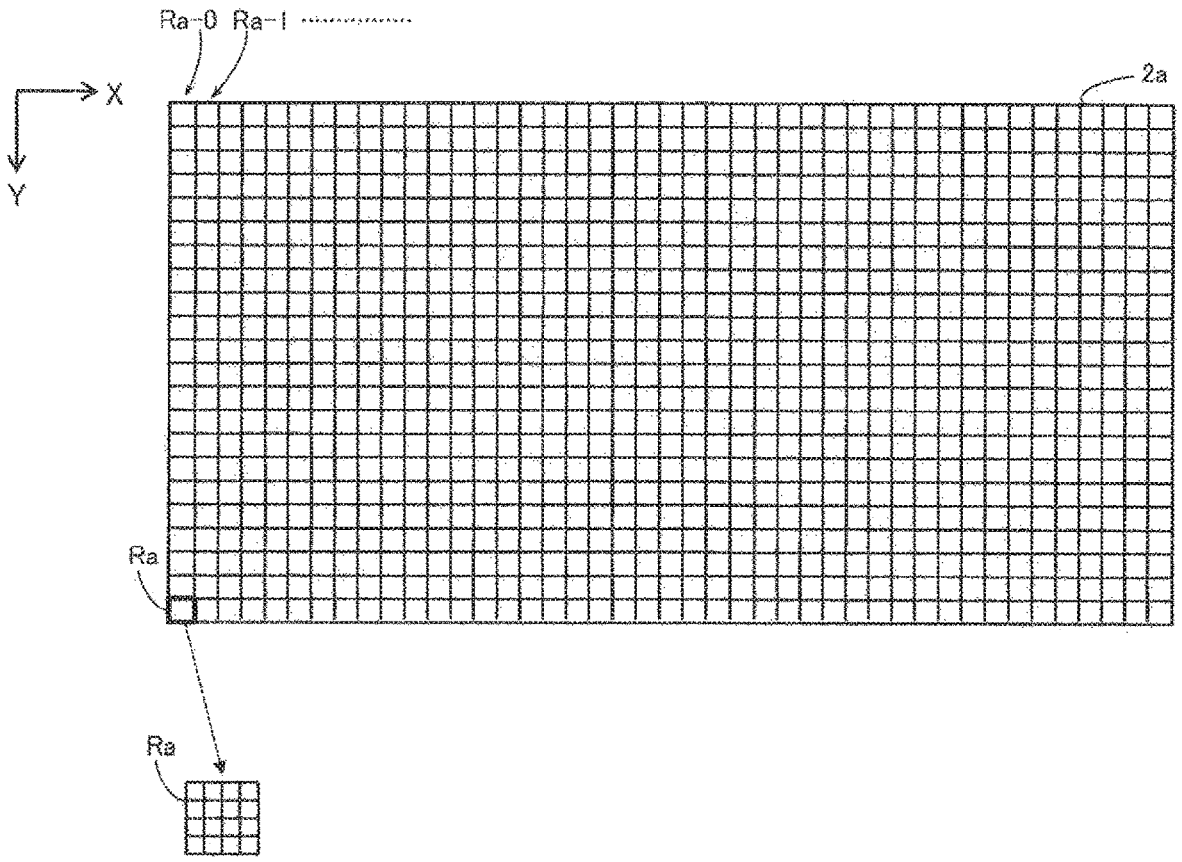
FIG. 4 is a diagram for describing divisions for which the unevenness correction data is generated in the correction system.
Figure 5:
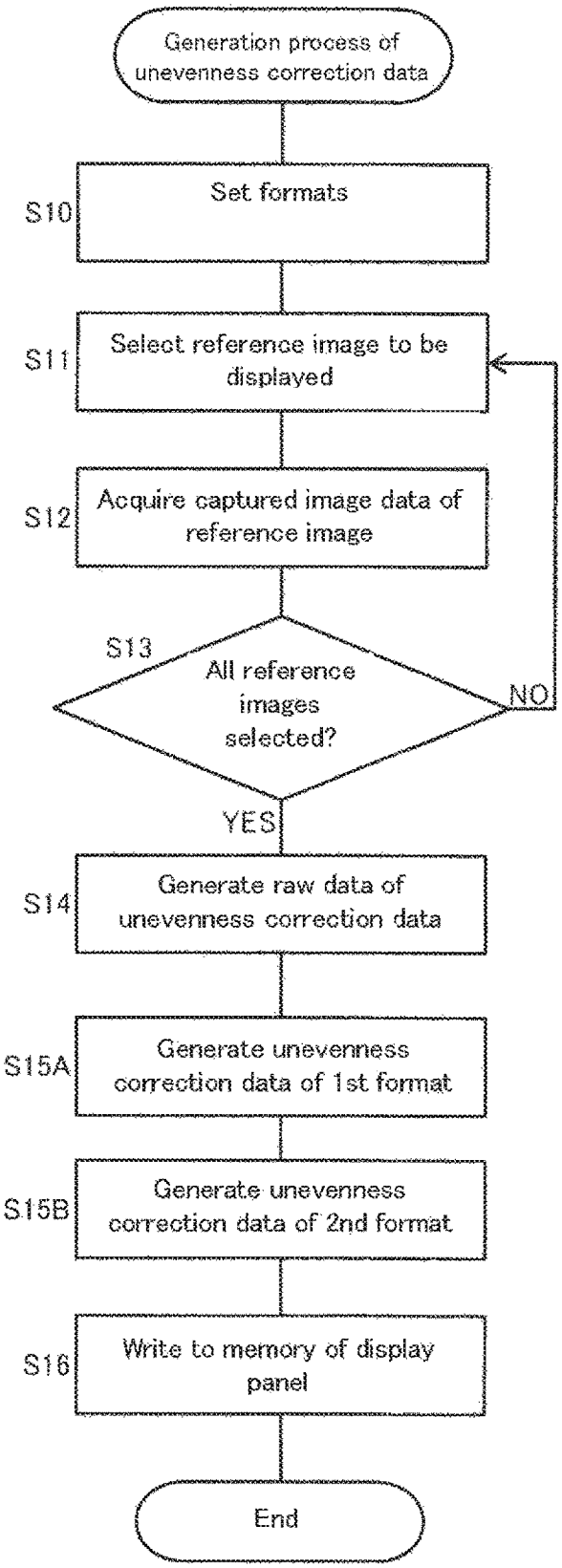
FIG. 5 is a flowchart depicting a generation process of the unevenness correction data in the correction system.
Figure 6:
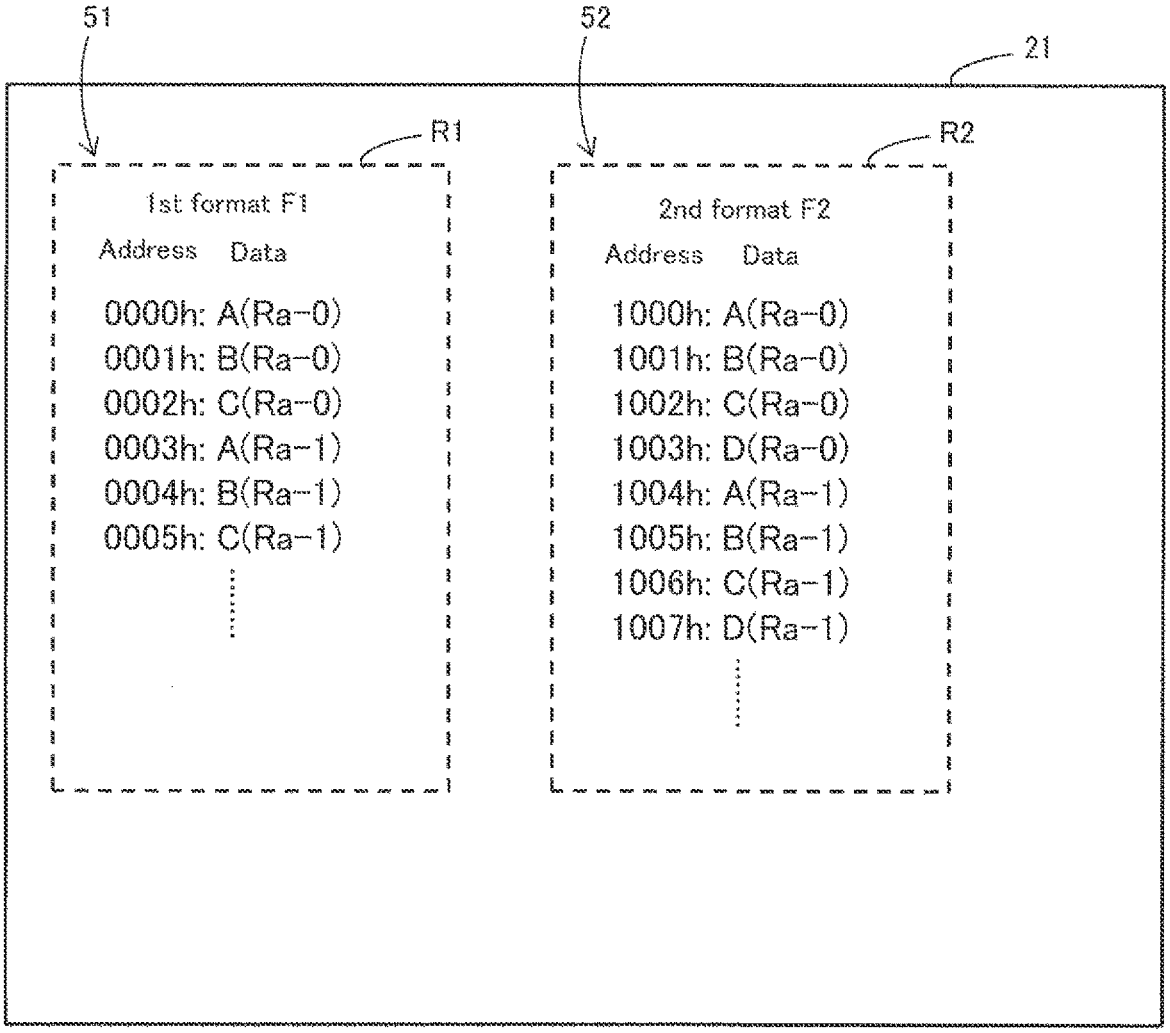
FIG. 6 is a diagram for describing a storage area for the unevenness correction data in each format.

Therefore, in the correction system 1 according to the present embodiment, the unevenness correction data 51 and 52 respectively corresponding to the formats F1 and F2 is generated for each display panel 2 and all generated types of the unevenness correction data 51 and 52 are written to the memory 21 of the same display panel 2. Through the above, management of the display panels 2 for each specification of the panel control circuits is not necessary and the production management of the display panels 2 is simplified. The following describes the operation of the correction system 1 according to the present embodiment in detail, 2-2. Operation of Correction System The following describes the operation of the correction system 1 according the present embodiment with reference to FIGS. 4, 5, and 6, FIG. 4 is a diagram for describing divisions for which the unevenness correction data is generated in the correction system 1. FIG. 5 is a flowchart depicting a generation process of the unevenness correction data in the correction system 1. FIG. 6 is a diagram for describing a storage area for the unevenness correction data in each format.

The flowchart in FIG. 5 depicts the generation process of the unevenness correction data performed for one display panel 2 in the correction system 1. The unevenness correction data is for example data to be used by a panel control circuit 40 included in the display apparatus 4 to correct characteristic display unevenness of the display panel 2.

The flowchart in FIG. 5 starts in a state where the display panel 2 undergoing processing is connected to each section of the correction system 1 and seated. Each process in the present flowchart is performed by the PC 13 in the correction system 1. Also, information related for example to each format for items such as compression methods of a variety of formats and storage areas of the memory 21 associated with each format is prestored in the PC storage 31.

The PC controller 30 first sets a plurality of formats to be used to record the unevenness correction data (S10). In the following, an example is described in which the first and second formats F1 and F2 in FIG. 3 are set in Step S10.

Next, the PC controller 30 selects a reference image to be displayed on the display panel 2 undergoing processing (S11). The reference image is an image used as a reference for detecting display unevenness in the correction system 1, and is for example an image in which every pixel is set to a prescribed grayscale reference tone. According to the present embodiment, a plurality of reference images are used with mutually different reference tones. The reference tones are for example set to intermediate tones such as tone levels 40, 100, and 200 among 256 tones.

In Step S11, the PC controller 30 selects one of the reference tones and transmits an instruction to display the reference image corresponding to the selected reference tone to the signal source 11 (FIG. 1). The signal source 11 generates an image signal of the reference image indicated by the received instruction and outputs the image signal to the panel control circuit 14. The panel control circuit 14 refers to information stored in the memory 21 of the display panel 2 undergoing processing and directs the display panel 2 to display the reference image based on the image signal from the signal source 11. Data of initial values in which the correction amount is 0 is prestored in an area of the memory 21 in which the unevenness correction data is stored. As such, the reference image is displayed in the display area 2*a* of the display panel 2 without any particular correction of display unevenness in Step S11.

Next, the PC controller 30 for example controls image capture operation through which the camera 12 captures an image of the reference image displayed on the display panel 2 and acquires captured image data indicating the captured image of the reference image from the camera 12 (S12).

Next, the PC controller 30 determines whether or not all of the reference images have been selected (S13). When not all of the reference images have been selected (NO in S13), an unselected reference image is selected and the process repeats from Step S11. Through the above, captured image data of all reference images is acquired.

When all reference images have been selected (YES in S13), the PC controller 30 generates raw data of the unevenness correction data for each of the reference tones based on the captured image data of the respective reference images (S14). The following describes divisions in the display area 2*a* using FIG. 4.

FIG. 4 illustrates the arrangement of a plurality of divisions Ra in the display area 2*a* of the display panel 2. As illustrated in FIG. 4, the divisions Ra divide the display area 2*a* into a matrix. In the following, a row direction of the matrix in the display area 2*a* is referred to as an X direction, and a column direction is referred to as a Y direction.

The raw data of the unevenness correction data includes a plurality of correction amounts assigned for each division Ra. Each division Ra includes a prescribed number of pixels in the display area 2*a* of the display panel 2. The division Ra includes 4×4 pixels as illustrated in FIG. 4, for example. Each division Ra in the display area 2*a* is identified by for example coordinates (X, Y) within a prescribed range such as X=0 to 479 and Y=0 to 269. In FIG. 4, (X,Y)=(0,0), (1,0), and so forth in the stated order are respectively identified as divisions Ra-0, Ra-1, and so forth.

In Step S14 of FIG. 5, the PC controller 30 first extracts, based on the captured image data of a specific reference image, the luminance of the reference tone in a captured image indicated by the captured image data from the luminance distribution of the display area in the captured image. The PC controller 30 detects areas with luminance deviating from the luminance of the extracted reference tone, deviations in luminance, and the like for each division Ra in the display area 2*a* in the captured image. The PC controller 30 performs a computation process through which an amount that a tone level is to be shifted for correction of a detected deviation is calculated as a correction amount (shift amount) for each division Ra based on a prescribed gamma characteristic curve. The PC controller 30 performs the above process for each captured image data of the reference images and generates raw data of the unevenness correction data in each reference tone.

Next, the PC controller 30 compresses the raw data of the generated unevenness correction data based on the first format F1 ((a) in FIG. 3) to generate the unevenness correction data 51 in the first format F1 (S15A).

In Step S15A for example, the PC controller 30 sets multiple groups of input values Vin and output values Vout in the formula (1) based on the tone levels of the reference tones and the corresponding correction amounts in the raw data of the unevenness correction data. The PC controller 30 calculates the parameters A, B, and C of the formula (1) based on the formula (1) to which each group of input values Vin and output values Vout has been set. The PC controller 30 calculates the parameters A, B, and C of the formula (1) in each division Ra to generate the unevenness correction data 51 in the first format F1.

The PC controller 30 also compresses the raw data of the generated unevenness correction data based on the second format F2 ((b) in FIG. 3) which differs from the first format F1 to generate the unevenness correction data 52 in the second format F2 (S15B).

In Step S15B for example, the PC controller 30 uses the formula (2), instead of the formula (1) used in Step S15A, to calculate the parameters A, B, C, and D based on the reference tones and the correction amounts in the raw data of the unevenness correction data. Note that the order of the processes of Steps S15A and S15B is not particularly limited. For example, the process of Step S15A may be performed after the process of Step S15B, or the processes of Steps S15A and S15B may be performed in parallel.

Next, the PC controller 30 records the unevenness correction data 51 in the first format F1 and the unevenness correction data 52 in the second format F2 in the memory 21 of the display panel 2 (S16). In the memory 21, a storage area for recording the unevenness correction data 51 and 52 according to the respective formats F1 and F2 is preset. The storage area of the unevenness correction data 51 and 52 in the memory 21 is described using FIG. 6.

FIG. 6 illustrates first and second areas R1 and R2 in the storage area of the memory 21. The storage area of the memory 21 is predivided into areas for each format F1 and F2. The first area R1 is an area associated with the first format F1 in the storage area of the memory 21, and includes addresses "0000h", "0001h", and so forth. The second area R2 is an area associated with the second format F2 in the storage area of the memory 21, and includes addresses "1000h", "1001h", and so forth, Each address is for example a logical address. The first and second areas R1 and R2 have sizes that are at least the data sizes of the respective unevenness correction data 51 and 52.

In Step S16, the PC controller 30 writes the unevenness correction data 51 in the first format F1 in order from the address "0000h" in the first area R1 of the memory 21 as illustrated in FIG. 6. As for the unevenness correction data 52 in the second format F2 by contrast, the PC controller 30 writes in order from the address "1000h" in the second area R2.

Referring back to FIG. 5, the PC controller 30 ends the process of the present flowchart by writing the unevenness correction data 51 and 52 in the respective formats F1 and F2. Upon ending the process of the present flowchart on one display panel 2, the correction system 1 moves on to the next display panel 2 as a display panel 2 to undergo processing and performs the same process.

Through the above process, the unevenness correction data 51 and 52 for correcting characteristic display unevenness of the display panel 2 undergoing processing is stored in the memory 21 of the display panel 2 in the formats F1 and F2. Through the above, display unevenness of the same display panel 2 can be corrected by the panel control circuits 40A and 40B with specifications respectively corresponding to the formats F1 and F2, and the production management of the display panels 2 can be facilitated.

An example is described above in which the unevenness correction data 51 and 52 in the first and second formats F1 and F2 are generated (515A, 515B), but the present invention is not limited as such, and more than two types of formats may be used.

The format to be used to record the unevenness correction data in Step S10 may be set for example by a selection operation of a user through the operation section 35. The setting in Step S10 may also be held over from the setting used in the display panel 2 having previously undergone processing. The PC controller 30 generates, according to the formats set in Step S10, the unevenness correction data in the same manner as in Steps S15A and S15B.

3. Display Apparatus

Figure 7:
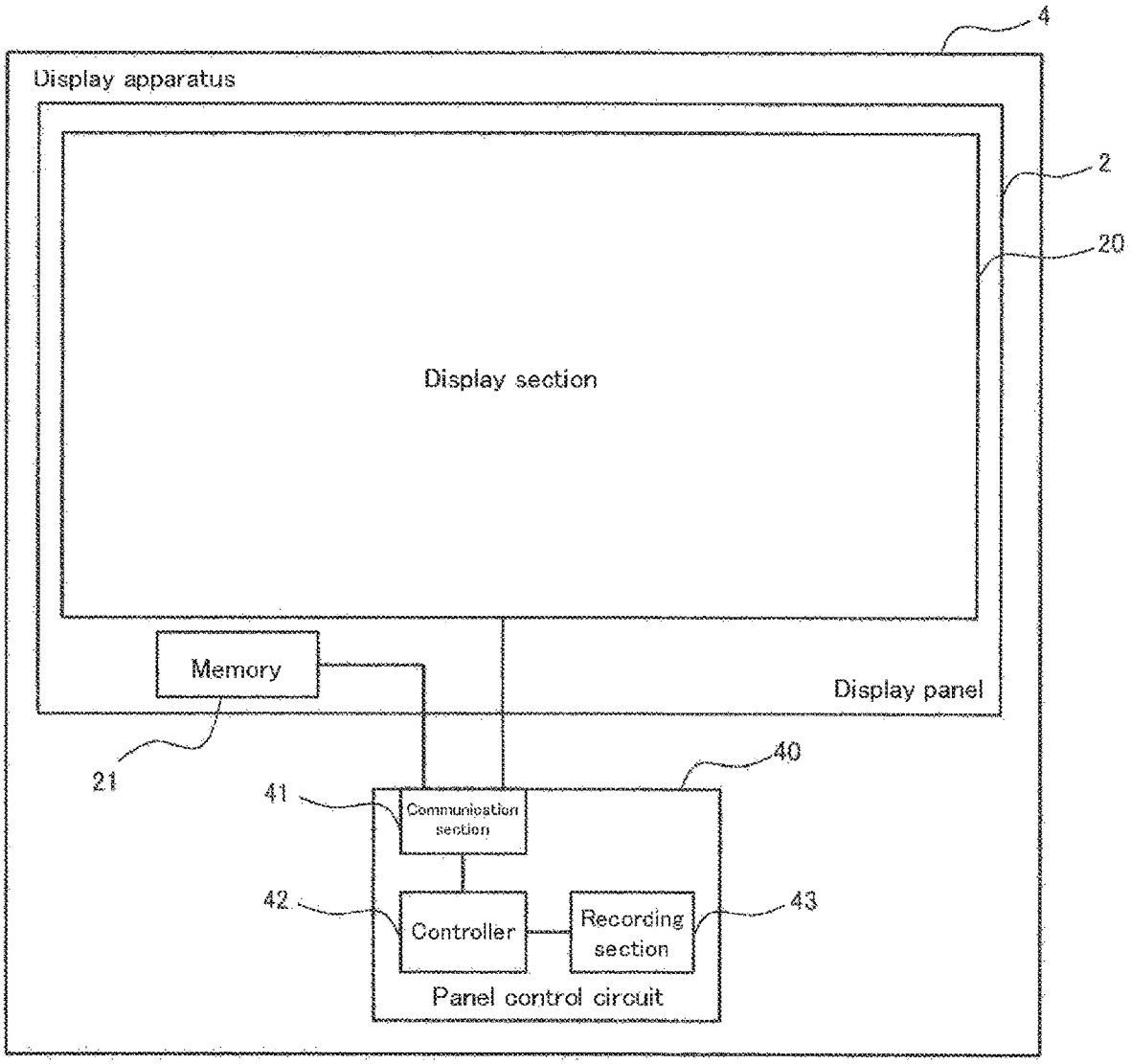
FIG. 7 is a block diagram illustrating a configuration of a display apparatus according to the first embodiment.

According to the present embodiment as described above, a display panel 2 to which the unevenness correction data 51 and 52 in the formats F1 and F2 are set by the correction system 1 constitutes a display apparatus 4 by being included in the display apparatus 4 together with a panel control circuit 40 (FIG. 7). The following describes configuration and operation of the display apparatus 4 according to the present embodiment.

3-1. Configuration of Display Apparatus

The following describes the configuration of a display apparatus according to the first embodiment with reference to FIG. 7. FIG. 7 is a block diagram illustrating the configuration of the display apparatus 4 according to the present embodiment.

The display apparatus 4 includes a display panel 2 and a panel control circuit 40 as illustrated in FIG. 7, The display apparatus 4 constitutes a liquid crystal television, for example. The display apparatus 4 may also be a display module included in various electronic devices.

The display panel 2 is set with the unevenness correction data 51 and 52 as a subject of processing by the correction system 1 according U the present embodiment. The display panel 2 includes a display section 20 and the memory 21.

The display section 20 includes a plurality of pixels constituting the display area 2*a* (refer to FIG. 1) in which an image is displayed on the display panel 2 and respective drive circuits for the pixels.

Characteristic information of the display panel 2 recorded in the correction system 1 is stored for example in the memory 21.

The panel control circuit 40 constitutes a timing controller which generates drive timing for the drive circuits in the display section 20 in the display apparatus 4. The panel control circuit 40 in the display apparatus 4 may have various specifications differing from the panel control circuit 14 in the correction system 1. The following describes the configuration of the panel control circuit 40 in detail.

3-1-1. Configuration of Panel Control Circuit

As illustrated in FIG. 7, the panel control circuit 40 includes a communication section 41, a controller 42, and a recording section 43. The panel control circuit 40 is an example of a control circuit of the display panel 2 in the display apparatus 4.

The communication section 41 is an interface circuit (module) for communicably connecting the panel control circuit 40 to the display panel 2. For example, the communication section 41 transmits and receives data between the controller 42 of the panel control circuit 40 and the memory 21 of the display panel 2 in accordance with a standard such as SPI. The communication section 41 also transmits and receives various signals between the controller 42 and the display section 20.

The controller 42 for example includes a CPU or an MPU which implements prescribed functions in cooperation with software and controls overall operation of the panel control circuit 40. The controller 42 also includes RAM (internal memory) used as a work area. The controller 42 reads out data or programs from the recording section 43 to the work area to perform various computation processes and implement various functions. For example, the controller 42 performs a display control process by executing a prescribed program. The display control process is a process through which the panel control circuit 40 controls display of an image for correction of display unevenness of the display panel 2 in the display apparatus 4 (refer to FIG. 8).

The recording section 43 is a recording medium in which data and programs such as firmware necessary to implement the functions of the panel control circuit 40 are recorded. The recording section 43 is configured as flash memory, for example. The recording section 43 stores for example programs for causing the controller 42 to perform the above display control process.

Note that the controller 42 in the panel control circuit 40 may be a hardware circuit such as a dedicated electronic circuit or a reconfigurable electronic circuit designed to implement a prescribed function. The controller 42 may also be configured as various semiconductor integrated circuits such as a CPU, an MPU, a microcomputer, a DSP, an FPGA, or an ASIC.

3-2. Operation of Display Apparatus

Figure 8:
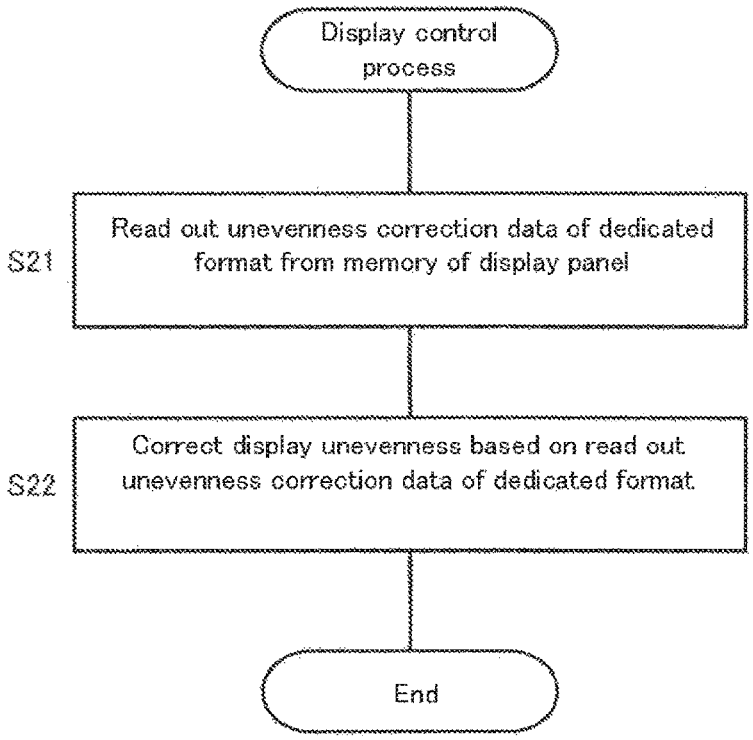
FIG. 8 is a flowchart depicting a display control process in a panel control circuit of the display apparatus.

The following describes the operation of the display apparatus 4 according to the present embodiment with reference to FIG. 8. FIG. 8 is a flowchart depicting the display control process in the panel control circuit 40 of the display apparatus 4.

The flowchart depicted in FIG. 8 is performed by the controller 42 of the panel control circuit 40. In the following, a dedicated format unique to the panel control circuit 40 is assumed to be the first format F1 as an example (refer to (a) in FIG. 3). Also, items such as information indicating the first area R1 in the storage area of the memory 21, a head address ("0000h" in the example in FIG. 6) for example of the first area R1, and data size are assumed to be prerecorded in the recording section 43 of the panel control circuit 40.

In the flowchart of FIG. 8, the controller 42 first refers to information recorded in the recording section 43 and reads out the unevenness correction data 51 in the first format F1 from the memory 21 of the display panel 2 (S21).

In the present example, the controller 42 reads out data of the data size of the unevenness correction data 51 from the address "0000h" in the memory 21 of the display panel 2 based on the information indicating the first area R1. Through the above, the controller 42 obtains the unevenness correction data 51 in the first format F1 written by the correction system 1.

Next, the controller 42 controls display of an image in the display panel 2 for correction of display unevenness based on the read out unevenness correction data 51 (S22).

In Step S22, the controller 42 first acquires image data externally input to the panel control circuit 40. Next, the controller 42 for example performs the computation process of the formula (1) based on the input value Yin indicating the tone of the pixels in the image data and the values of the parameters A, B, and C corresponding to the divisions Ra included by the same pixels in the unevenness correction data 51, and calculates the output value Vout. The controller 42 performs the computation process of the formula (1) for each pixel, and outputs an image signal indicating the calculated output value Vout of each pixel together with various control signals to the display panel 2 through the communication section 41.

The process in Step S22 as above is continually performed while for example the image data is being externally input to the panel control circuit 40. Also, the controller 42 ends the process of Step S22 when for example an instruction to finish display control is externally input to the panel control circuit 40.

Through the above process, unevenness correction can be appropriately performed on the display panel 2 (S22) by panel control circuits 40 corresponding to the formats used in the correction system 1 reading out the unevenness correction data in the respective formats from the memory 21 of the display panel 2 (S21).

Information indicating a storage area in which unevenness correction data of a corresponding dedicated format is written to the memory 21 of the display panel 2 is preset according to the specification of the panel control circuit 40. Through the above, unevenness correction data of dedicated formats unique to panel control circuits 40 of various specifications can be read out (S21).

As described above in Step S21, the panel control circuit uses preset address information to read out unevenness correction data of a unique dedicated format. The process in Step S21 is not limited as such, and for example the panel control circuit 40 may detect the unevenness correction data in the dedicated format of the panel control circuit 40 in the storage area of the memory 21. For example, when the PC 13 (PC controller 30) writes the unevenness correction data in each format to the memory 21 in the correction system 1, information indicating the format is embedded in a header of the unevenness correction data. The controller 42 of the panel control circuit 40 reads out the header of the unevenness correction data from the memory 21 and determines whether or not the information indicating the dedicated format unique to each header is included in each header.

4. Summary

The correction system 1 according to the present embodiment generates unevenness correction data used by a panel control circuit 40 to correct display unevenness of a display panel 2. The correction system 1 includes the signal source 11, the camera 12, and the PC 13. The signal source 11 outputs a signal to cause a prescribed reference image to be displayed on the display panel 2. The camera 12 captures an image of the reference image displayed on the display panel 2 based on the signal from the signal source 11 and generates a captured image. The PC 13 generates unevenness correction data for the display panel 2 based on the captured image. The PC 13 generates the unevenness correction data 51 and 52 in the mutually different first and second formats and F2 for the display panel 2 and records the unevenness correction data 51 and 52 to the memory 21 of the display panel 2.

Through the above correction system 1, the unevenness correction data 51 and 52 in the mutually different formats F1 and F2 are set to the display panel 2. Through the above, complexity of individually managing, for each format, display panels 2 to which the unevenness correction data 51 and 52 of the formats F1 and F2 are set is reduced. Thus, the production management of the display panels 2 can be facilitated.

According to the present embodiment, the formats F1 and F2 include dedicated formats dependent on the specification of a panel control circuit 40 of a display panel 2, Through the above, it becomes unnecessary to specially manage display panels 2 to which unevenness correction data correspondable to a specific specification of the panel control circuit 40 is set, and the production management of the display panels 2 can be simplified.

Also according to the present embodiment, the formats F1 and F2 include dedicated formats according to mutually different specifications of the panel control circuits 40 of the display panels 2. Through the above, it becomes unnecessary to individually manage the display panels 2 for each specification of the panel control circuits 40, and production management of the display panels 2 can be simplified.

Also according to the present embodiment, the PC 13 records the unevenness correction data 51 and 52 in the formats F1 and F2 to the respective storage areas R1 and R2 according to the respective formats F1 and F2 in the memory 21 of a display panel 2.

Through the above, display unevenness can be corrected based on the unevenness correction data 51 and 52 in the respective formats F1 and F2 by setting information indicating the storage areas R1 and R2 to which the unevenness correction data 51 and 52 in the respective formats F1 and F2 are recorded to the control circuit 40 of the display panel 2.

Also in the display panel 2 according to the present embodiment, display of an image is controlled by the panel control circuit 40. The display panel 2 includes the display section 20 which displays an image and the memory 21 to which characteristic information of the display panel 2 is stored. The memory 21 stores the unevenness correction data 51 and 52 in the mutually different formats F1 and F2 which are unevenness correction data used by the panel control circuit 40 to correct display unevenness of the display panel 2.

Through the above display panel 2, the complexity of managing display panels 2 for each format of the unevenness correction data 51 and 52 is reduced, and the production management of the display panels 2 can be facilitated.

The display apparatus 4 according to the present embodiment includes the display panel 2 and the panel control circuit 40. The panel control circuit 40 corrects display unevenness of the display panel 2 based on the unevenness correction data in a specific format among the unevenness correction data 51 and 52 in the formats F1 and F2 recorded in the memory 21. The display apparatus 4 can be configured using panel control circuits 40 with specifications varying according to the various formats F1 and F2.

Furthermore, a correction method according to the present embodiment is a method by which unevenness correction data to be used by the panel control circuit 40 for correcting display unevenness of the display panel 2 is generated. The present method includes a step in which the PC 13 causes a prescribed reference image to be displayed on the display panel 2. The present method includes a step in which the PC 13 causes the camera 12 to capture an image of the reference image displayed on the display panel 2 to generate a captured image. The present method includes a step in which the PC 13 generates unevenness correction data 50 and 51 in the mutually different formats F1 and F2 based on the captured image and records the unevenness correction data 50 and 51 to the memory 21 of the display panel 2.

Through the above correction method, the complexity of managing the display panels for each format of the unevenness correction data 51 and 52 is reduced, and the production management of the display panels 2 can be facilitated.

In addition, a program according to the present embodiment is a program for causing the PC 13 to perform the above correction method. Through the present program, the production management of the display panels 2 can be facilitated by causing the PC 13 to perform the above correction method.

Additional Embodiment

In the above first embodiment, the formats F1 and F2 used in the correction system 1 are dedicated formats dependent on the specification of the panel control circuit 40. The formats used in the correction system 1 are not limited to dedicated formats, and may include a generic format that is not dependent on the specification of the panel control circuit 40. The following describes a variation using FIG. 9.

Figure 9:
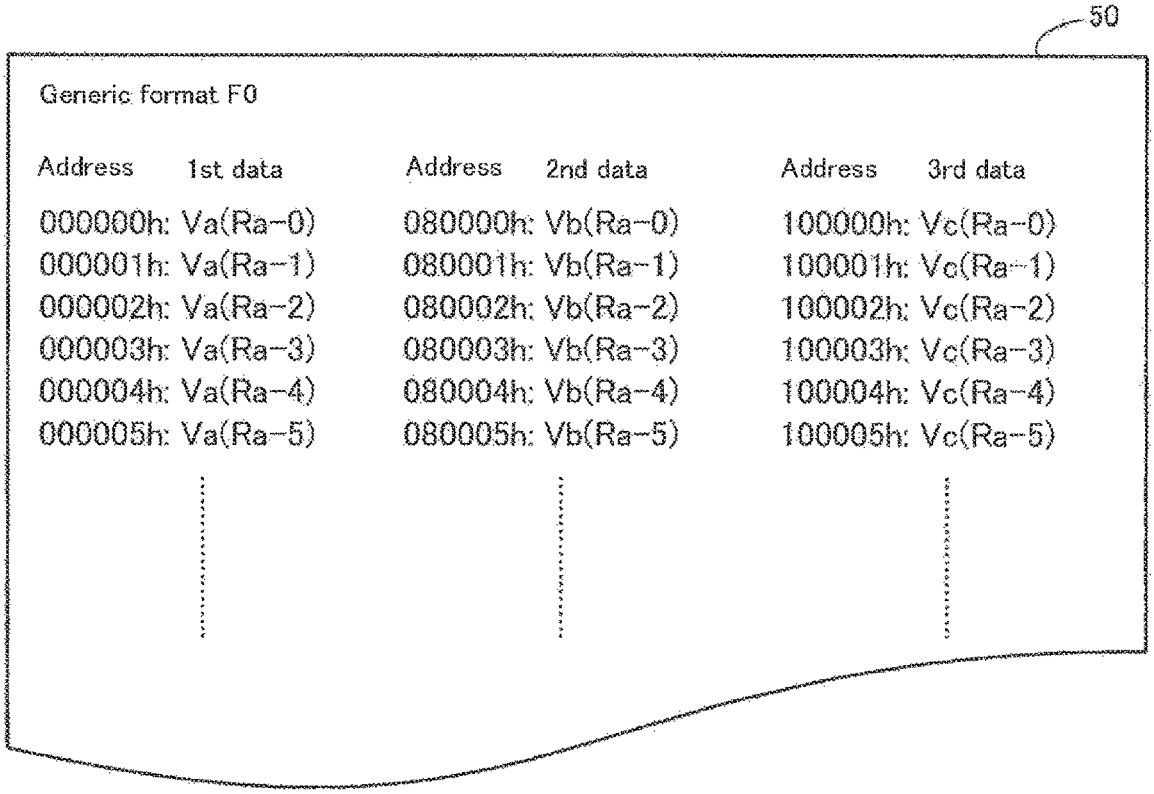
FIG. 9 is a diagram for describing a variation of the formats of the unevenness correction data.

FIG. 9 illustrates the unevenness correction data 50 stored in a generic format F0 as an example. According to the present variation, the generic format F0 defines a correction amount (shift amount) for each reference tone used in the correction system 1 for each division Ra. The following describes an example of the generic format F0 based on first, second, and third reference tones (for example respective tone levels 40, 100, and 200) using three reference tones in the correction system 1.

Following the generic format F0, the unevenness correction data 50 illustrated in FIG. 9 is storing values of first, second, and third data Va(Ra-n), Vb(Ra-n), and Vc(Ra-n) of each division Ra-n (n=0, 1, . . . ). The first data Va(Ra-n) expresses a correction amount for the first reference tone (tone level 40) in a specific division Ra-n. In the same manner, the second data Vb(Ra-n) expresses a correction amount for the second reference tone (tone level 100) in the same division Ra-n, and the third data Vc(Ra-n) expresses a correction amount for the third reference tone (tone level 200) in the same division Ra-n.

The generic format as above for example maintains all information expressing characteristic display unevenness of the display panel 2 in raw data of the unevenness correction data generated by the correction system 1. By writing the unevenness correction data 50 following the generic format F0 to the memory 21 in the correction system 1, the unevenness correction data 50 in the generic format F0 can be used when for example it is necessary to set the unevenness correction data to follow a new dedicated format.

That is, the PC 13 or the like reads out the unevenness correction data 50 in the generic format F0 from the memory 21 of the display panel 2 and can generate the unevenness correction data following a new dedicated format by converting the unevenness correction data 50 in the generic format F0. Through the above, duplicated work such as repeating the process from acquisition of the captured image in the correction system 1 can be avoided, and the production management of the display panels 2 can be facilitated.

In each embodiment as above, an example is described in which the reference images are set to grayscale. However, the reference images are not limited as such and may for example be set to a prescribed tone of a single color among three colors (four colors when the pixels are configured as four colors): red, green, and blue (RGB).

Also according to each of the above embodiments, the PC 13 is used as an example of a control device in the correction system 1. However, a control device may be configured using various information processing devices instead of the PC 13. Furthermore, the control device and the signal source may be configured as integral with each other for example using an information processing device in which the signal source is integrally included.

Furthermore, an example is described in each of the above embodiments in which the display panel 2 undergoing processing in the correction system 1 is a liquid crystal panel, but the present invention is not limited as such. For example, the present invention may also be applied to an organic EL display panel.

The invention claimed is:

1. A correction system for generating an unevenness correction data set to be used by a control circuit for correcting display unevenness of a display panel, the correction system comprising:

a signal source configured to output a signal to cause a prescribed reference image to be displayed on the display panel;

a camera configured to generate a captured image by capturing an image of the reference image displayed on the display panel based on the signal; and a computer configured to generate the unevenness correction data set for the display panel based on the captured image, wherein the computer generates a plurality of unevenness correction data sets respectively corresponding to a plurality of mutually different formats for the display panel and records the unevenness correction data sets to storage of the display panel, and the unevenness correction data sets include a first unevenness correction data set which is usable by a first control circuit but is not usable by a second control circuit and a second unevenness correction data set which is not usable by the first control circuit but is usable by the second control circuit.

2. The correction system according to claim 1, wherein the formats include a dedicated format dependent on a specification of the control circuit of the display panel.

3. The correction system according to claim 2, wherein the formats include a plurality of dedicated formats according to a plurality of mutually different specifications of the control circuit of the display panel.

4. The correction system according to claim 1, wherein the formats include a generic format not dependent on a specification of the control circuit of the display panel.

5. The correction system according to claim 4, wherein an unevenness correction data set corresponding to the generic format is an unevenness correction data set which serves as a basis for generating a third unevenness correction data set which is not usable by the first and second control circuits but is usable by a third control circuit.

6. The correction system according to claim 1, wherein the computer records the unevenness correction data set in each format in respective storage areas according to the respective formats in the storage of the display panel.

7. The correction system according to claim 1, wherein the control circuit is a circuit which controls image display of the display panel, when the display panel is controlled by the first control circuit, an image signal input to the first control circuit is corrected based on the first unevenness correction data set and a corrected image signal is output to the display panel, and when the display panel is controlled by the second control circuit, an image signal input to the second control circuit is corrected based on the second unevenness correction data set and a corrected image signal is output to the display panel.

8. The correction system according to claim 1, wherein in recording the unevenness correction data sets to the storage of the display panel, the computer embeds information indicating a format corresponding to one of the unevenness correction data sets in a header of the one unevenness correction data set.

9. A display panel in which display of an image is controlled by a control circuit, the display panel comprising:

a display section configured to display the image; and storage configured to store characteristic information of the display panel, wherein the storage stores therein a plurality of unevenness correction data sets to be used by the control circuit for correcting display unevenness of the display panel, the unevenness correction data sets respectively corresponding to a plurality of mutually different formats, and the unevenness correction data sets include a first unevenness correction data set which is usable by a first control circuit but is not usable by a second control circuit and a second unevenness correction data set which is not usable by the first control circuit but is usable by the second control circuit.

10. A display apparatus comprising:

the display panel according to claim 9; and a control circuit configured to correct display unevenness of the display panel based on an unevenness correction data set in a specific format among the unevenness correction data sets in the plurality of formats recorded in the storage.

11. The display device according to claim 10, wherein the control circuit is a control circuit which controls image display of the display panel, corrects an input image signal based on the first unevenness correction data set and outputs a corrected image signal to the display panel when the control circuit is the first control circuit, and corrects an input image signal based on the second unevenness correction data set and outputs a corrected image signal to the display panel when the control circuit is the second control circuit.

12. The display device according to claim 10, wherein the unevenness correction data set in each format is stored in respective storage areas according to the respective formats in the storage, and information indicating a storage area corresponding to the specific format is recorded in the storage.

13. The display panel according to claim 9, wherein information indicating a format corresponding to one of the unevenness correction data sets is included in a header of the one unevenness correction data set.

14. The display panel according to claim 9, wherein the formats include a generic format which is not dependent on a specification of the control circuit of the display panel, and an unevenness correction data set corresponding to the generic format is an unevenness correction data set which serves as a basis for generating a third unevenness correction data set which is not usable by the first and second control circuits but is usable by a third control circuit.

15. A correction method for generating an unevenness correction data set to be used by a control circuit for correcting display unevenness of a display panel, the correction method comprising implementation by a computer of:

displaying a prescribed reference image on the display panel;

generating a captured image by causing a camera to capture an image of the reference image displayed on the display panel; and generating a plurality of unevenness correction data sets respectively corresponding to a plurality of mutually different formats based on the captured image and recording the unevenness correction data sets to storage of the display panel, the unevenness correction data sets including a first unevenness correction data set which is usable by a first control circuit but is not usable by a second control circuit and a second unevenness correction data set which is not usable by the first control circuit but is usable by the second control circuit.

16. A computer-readable storage medium on which a program is non-temporarily stored, wherein the program is for causing a computer to perform the correction method according to claim 15.

17. The correction method according to claim 15, wherein the control circuit is a circuit which controls image display of the display panel, when the display panel is controlled by the first control circuit, an image signal input to the first control circuit is corrected based on the first unevenness correction data set and a corrected image signal is output to the display panel, and when the display panel is controlled by the second control circuit, an image signal input to the second control circuit is corrected based on the second unevenness correction data set and a corrected image signal is output to the display panel.

18. The correction method according to claim 15, wherein in recording the unevenness correction data sets to the storage of the display panel, information indicating a format corresponding to one of the unevenness correction data sets is embedded in a header of the one unevenness correction data set.

19. The correction method according to claim 15, wherein the formats include a generic format which is not dependent on a specification of the control circuit of the display panel, and an unevenness correction data set corresponding to the generic format is an unevenness correction data set which serves as a basis for generating a third unevenness correction data set which is not usable by the first and second control circuits but is usable by a third control circuit.

* * * * *